US010612192B2

(12) United States Patent
Gronych et al.

(10) Patent No.: US 10,612,192 B2
(45) Date of Patent: Apr. 7, 2020

(54) PRESS FOR A MACHINE FOR PRODUCING A FIBROUS MATERIAL WEB

(71) Applicant: Voith Patent GmbH, Heidenheim (DE)

(72) Inventors: Daniel Gronych, Heidenheim (DE); Thomas Rühl, Wernau (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 16/047,050

(22) Filed: Jul. 27, 2018

(65) Prior Publication Data

US 2018/0371693 A1 Dec. 27, 2018

Related U.S. Application Data

(63) Continuation of application No. PCT/EP2016/080968, filed on Dec. 14, 2016.

(30) Foreign Application Priority Data

Jan. 29, 2016 (DE) ..... 10 2016 201 338

(51) Int. Cl.
*D21F 7/02* (2006.01)
*D21F 3/04* (2006.01)
(Continued)

(52) U.S. Cl.
CPC ..... *D21F 3/045* (2013.01); *D21F 3/04* (2013.01); *D21F 3/10* (2013.01); *D21F 7/02* (2013.01); *D21F 1/40* (2013.01)

(58) Field of Classification Search
USPC ..... 162/358.1
See application file for complete search history.

(56) References Cited

U.S. PATENT DOCUMENTS 7,294,236 B2 * 11/2007 Halme ..... D21F 3/0272 162/358.1
2001/0009181 A1 * 7/2001 Steiner ..... D21F 3/04 162/358.1

(Continued)

FOREIGN PATENT DOCUMENTS

DE 102 31 074 A1 1/2004
DE 10 2011 082 161 A1 3/2013
EP 1 375 740 A1 1/2004

OTHER PUBLICATIONS

Notice of Transmission of the International Research Report and the Written Notice Issued the International Searching Authority or Declaration dated Mar. 2, 2017 for International Application No. PCT/EP2016/080968 (10 pages).

(Continued)

*Primary Examiner* — Mark Halpern
(74) *Attorney, Agent, or Firm* — Taylor IP, P.C.

(57) ABSTRACT

The invention relates to a press for a machine for producing a fibrous material web, including at least one press nip formed between a press roller and a counter press roller of the press for guiding through the fibrous material web in a dehydrating manner, and two band shaped covers, which are each guided by multiple guide rollers in continuous circulation, so as to run together through the press nip, so that the fibrous material web is guided through sandwiched between said covers, and then separated again at a separation point, in order to continue guiding the fibrous material web on the one cover and separate it from the other cover. One guide roller of the guide rollers arranged at the separation point is a suctioned guide roller of the one cover, to hold the fibrous material web on the one cover at the separation position.

10 Claims, 2 Drawing Sheets

(51) Int. Cl.
*D21F 3/10* (2006.01)
*D21F 1/40* (2006.01)

(56) References Cited

U.S. PATENT DOCUMENTS

| | | | | |
|---|---|---|---|---|
| 2001/0020524 | A1 | 9/2001 | Kotitschke et al. | |
| 2002/0096303 | A1 | 7/2002 | Satzger et al. | |
| 2006/0011319 | A1 * | 1/2006 | Honkalampi | D21F 3/045 162/205 |

OTHER PUBLICATIONS

German Office Action dated Oct. 13, 2016 for German Application No. 10 2016 201 338.6 (8 pages).

* cited by examiner

PRESS FOR A MACHINE FOR PRODUCING A FIBROUS MATERIAL WEB

CROSS REFERENCE TO RELATED APPLICATIONS

This is a continuation of PCT application No. PCT/EP2016/080968, entitled "PRESS FOR A MACHINE FOR PRODUCING A FIBROUS MATERIAL WEB", filed Dec. 14, 2016, which is incorporated herein by reference.

BACKGROUND OF THE INVENTION

1. Field of the Invention

The invention relates to a press for a machine for producing a fibrous material web, in particular a paper, cardboard, or pulp web.

2. Description of the Related Art

A press for a machine for producing a fibrous material web is known for example from DE 10 2011 082 161 A1. The press described therein includes at least one press nip and two ribbon-like fabrics in the embodiment of a bottom felt and a top felt. The at least one press nip is formed between a press roll and a counter press roll of the press in order to guide the fibrous web through, in a dewatering manner. The bottom felt and the top felt respectively are guided by a multitude of guide rolls, so that they are brought together when running through the press nip in order to run the fibrous web in a sandwich like manner between the press nip. After the press nip, the bottom felt and the top felt are again separated at a separation point in order to continue guiding the fibrous web on the bottom felt and to separate it from the top felt. One guide roll of a plurality of guide rolls that is arranged at the separation point is a vacuum equipped guide roll of the lower felt and among other things serves to hold the fibrous web on the bottom felt at the separation point. A vacuum equipped guide roll is also referred to as a suction felt guide roll.

Suction felt guide rolls are used in particular at web speeds in excess of 1100 m/min to 1200 m/min because in this case the previously described web separation by means of a cost-effective suction box is no longer possible. Suction felt guide rolls offer the advantage of a very reliable web separation up to high speeds, however they are very expensive in regard to investment costs, spare parts and maintenance.

A conventional suction felt guide roll usually has two or multiple zones, which is why a relatively expensive manifold becomes necessary for suction. A conventional suction felt guide roll moreover requires a rotary drive since it is subject to friction and uses up drive power in the felt loop. The drive moreover allows the felt tension to drastically drop directly after the press nip, which could lead to malfunctions in web travel.

If the rotary drive of the suction felt roll is provided together with the suction on one drive side of the press, the rotary drive must generally be designed eccentrical with a transmission. Alternatively, the rotary drive on the drive side can be designed centrically, in which case however the suction needs to be relocated to the operator side of the press, which is expensive.

Despite the provision of the suction felt roll after the double-felted press nip, problems often occur in conventional presses, based on declining felt tension after the suction felt guide roll. These problems relate for example to web travel in a transfer section after the first press nip between a suction felt guide roll to an infeed into a subsequent press stage with an additional press nip. This causes for example wrinkle formation directly after web separation which can also result in lifting of the web edge in the region of the subsequent press stage. The resulting web overstretching can then lead to considerable wrinkling after the press and to web breaks in a downstream pre-dryer section of the machine for the production of the fibrous web. Overall the reliability of web travel is hereby compromised.

In the press that is known from DE 10 2011 082 161 A1 attempts are made to increase the reliability of web travel in the region of a press stage, in that a vertical support element of the side of the top felt facing away from the web is in contact with said felt, so that an approximately convexly curved web travel path for the fibrous web results. However, this can cause additional web travel and therewith increased manufacturing costs, which is the case anyhow with the press known from DE 10 2011 082 161 A1 due to the provision of a steam blow box on the side of the top felt that is facing the web.

What is needed in the art is to provide a machine for the production of a fibrous web, so that increased reliability in web travel after the press nip that interacts with the two fabrics is achieved at low costs.

SUMMARY OF THE INVENTION

According to the present invention, a press for producing a fibrous web, in particular a paper, cardboard or pulp web includes a press nip that is formed between a press roll and a counter press roll of the press in order to guide the fibrous web through, in a dewatering manner; and two ribbon-like fabrics which respectively are guided by a multitude of guide rolls to run continuously. The two fabrics are guided so that they are brought together when running through the press nip in order to run the fibrous web in a sandwich like manner between them through the press nip. After the press nip, the two fabrics are again separated at a separation point in order to continue guiding the fibrous web on the one fabric and to separate it from the other fabric. One guide roll of a plurality of guide rolls that is arranged at the separation point is a suction guide roll of the one fabric and serves to hold the fibrous web on the one fabric at the separation point.

The press according to the present invention has one guide roll of the plurality of guide rolls of the one fabric that is located immediately following the suction guide roll in the continuous loop of the one fabric is equipped with a rotary drive. The guide roll that immediately follows the suction guide roll preferably has a central drive journal. Due to the fact that the guide roll that directly follows the suction guide roll has a rotary drive, the tension of the fabric that further guides the fibrous web after the separation point can be maintained over a much larger web travel distance after the press nip, in particular after a web removal by means of a separation suction roll of a subsequent processing stage, such as a press stage.

According to one embodiment of the invention, the rotary drive of the guide roll that directly follows the suction guide roll is designed for basis weights of the fibrous web from 25 $g/m^2$ to 500 $g/m^2$. Thereby, relatively heavy fibrous webs such as cardboard webs or packaging paper webs can be processed in the press in addition to relatively light fibrous webs such as paper webs.

According to an additional embodiment of the invention the rotary drive of the guide roll that directly follows the suction guide roll is designed so that it has a share of an overall rotary drive power of the respective press nip from 15 percent to 25 percent. In other words, the share of the rotary drive of the directly following guide roll amounts to 25 percent, preferably to 20 percent and even more preferably to 15 percent of the total rotary drive power of the press nip.

According to yet another additional embodiment of the invention, the rotary drive of the guide roll that directly follows the suction guide roll is torque controlled, whereas a rotary drive at the press nip is speed controlled.

According to yet another additional embodiment of the invention, the guide roll that directly follows the suction guide roll with the one fabric has a wrap angle of 60 degrees to 90 degrees. In other words, the angle of wrap is ≥60 degrees, preferably ≥80 degrees and more preferably ≥90 degrees.

According to one embodiment of the invention, the guide roll that directly follows the suction guide roll is pivoted such that when pivoting the directly following guide roll, a trajectory of the continuous travel of the one fabric can be altered. Thus, an angle of wrap for example of the one fabric can be adjusted precisely with a removal suction roll of a subsequent processing step, such as a press step, so that a stable web travel is assured.

According to yet another embodiment of the invention the shell surface of the guide roll that directly follows the suction guide roll is covered with a pressure absorbing or soft cover material which has a coefficient of friction of 0.2 to 0.25. In other words, the coefficient of friction of the cover material is ≥0.2 and preferably ≥0.25.

According to another embodiment of the invention, the suction guide roll with the one fabric has an angle of wrap of 15 degrees to 40 degrees. In other words, the angle of wrap is ≥15 degrees, preferably ≥30 degrees and even more preferably ≥40 degrees.

According to yet another embodiment of the invention, the suction guide roll has at least two zones, wherein at least one zone is a high vacuum zone having a vacuum of 35 kPa to 50 kPa. In other words, the available vacuum of each high vacuum zone is ≥35 kPa, preferably ≥45 kPa and even more preferably ≥50 kPa.

According to yet another embodiment of the invention, a transfer section from the departure point of the web-supporting fabric off the suction guide roll to the contact point of this fabric with a receiving suction roll located downstream in the travel path of the fibrous web for transfer of the fibrous web from this fabric to another fabric is 600 mm to 1000 mm. In other words, the transfer section is ≤1000 mm, preferably ≤800 mm and even more preferably ≤600 mm.

According to one embodiment of the invention, the suction guide roll has no rotary drive and no transmission. A manifold of the suction guide roll can thus be designed more simply. Alternatively, hereto, the suction guide roll can however also be equipped with a rotary drive and possibly a transmission in order to better distribute the rotary drive power.

According to another embodiment of the invention, the two fabrics are guided such that they run together into the press nip in order to avoid dropping off of the fibrous web if said web has a basis weight of >140 g/m$^2$.

According to another embodiment of the invention, at least one press nip of the press is in the embodiment of a shoe press nip. Each shoe press has a press force of >1000 kN/m and a shoe length of preferably >250 mm.

The fibrous web may be a packaging paper web or a cardboard web with a web travel speed generated in the press of ≥1100 m/min, preferably ≥1150 m/min and even more preferably ≥1200 m/min.

The invention expressly extends also to such embodiments whose combination of characteristics are not explicitly referenced in the claims, wherein the properties of the invention, in as far as technically feasible, can be randomly combined with each other.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
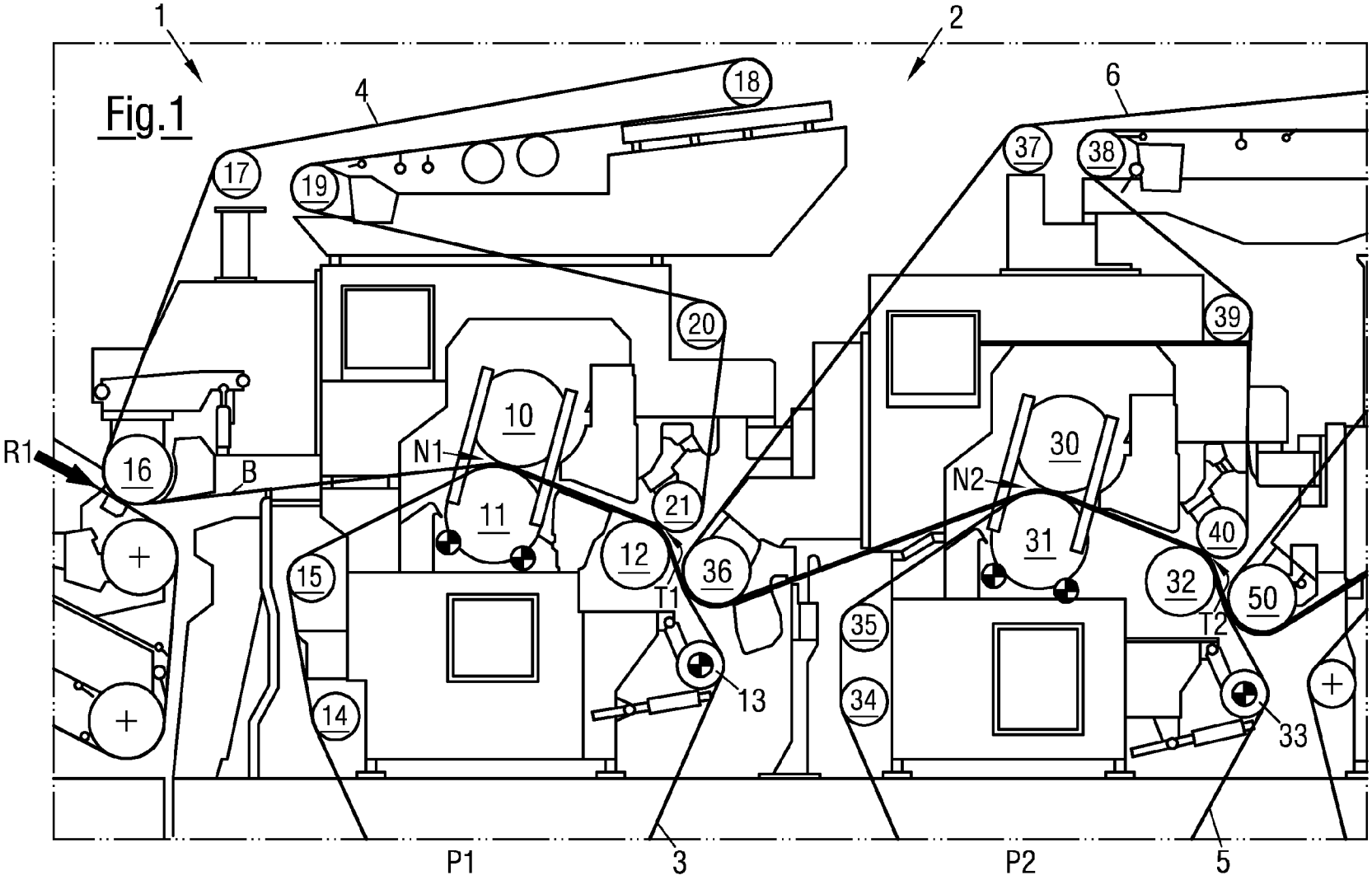
FIG. 1 shows a schematic side view of a press for a machine to produce a fibrous web according to one embodiment of the invention.

Referring to the drawings and more particularly to FIG. 1 there is shown a press 2 of a machine 1 (not shown in its entirety) to produce a fibrous web B, according to a first embodiment is described with reference to FIG. 1. In the present embodiment of the invention, press 2 is a so-called tandem press with two consecutive press stages P1, P2.

Machine 1 in the present embodiment of the invention is a paper machine for the production of a paper, cardboard or pulp web in the form of a fibrous web B. Fibrous web B can be a packaging paper web or a cardboard web and is run in press 2 at a web speed of ≥1100 m/min, preferably ≥1150 m/min and even more preferably ≥1200 m/min in a direction of web travel R1.

In its first press stage P1, press 2 has a first press nip N1 which is formed between press roll 10 and a counter press roll 11 of first press stage P1 in order to guide fibrous web B through, in a dewatering manner. In other words, first press stage P1 of press 2 is equipped with press roll 10 and counter press roll 11 which interact so that together they form first press nip N1 in order to guide fibrous web B through said press nip, in a dewatering manner.

In its first press stage P1, press 2 moreover has two ribbon-like fabrics 3, 4 wherein a first fabric 3 is in the embodiment of a bottom felt or bottom press felt and a second fabric 4 is in the embodiment of a top felt or top press felt.

First fabric 3 is guided by multiple guide rolls 12-15 (not all guide rolls are depicted in FIG. 1) in continuous circulation. Second fabric 4 is guided by another set of multiple guide rolls 16-21 in continuous circulation. Both fabrics 3, 4 can be guided in first press stage P1 in such a way that they are brought together when running through press nip N1 in order to run fibrous web B in a sandwich like manner through first press nip N1. Fabrics 3, 4 can be guided in such a way that they run together into first press nip N1. Both fabrics 3, 4 are moreover led in first press stage P1 so that they are again separated after first press nip N1 at a first separation point T1 in order to continue to guide fibrous web B on first fabric 3 and to separate it from second fabric 4.

Suction guide roll 12 as the first of guide rolls 12-15 of first fabric 3 is arranged at first separation point T1 to hold fibrous web B at first separation point T1 on first fabric 3. Said first suction guide roll 12 is designed as a suction felt guide roll. A second guide roll 13 of guide rolls 12-15 of first fabric 3 that immediately follows first suction guide roll 12 in the continuous circulation of first fabric 3 is equipped with a rotary drive. This rotary drive of second guide roll 13 of first fabric 3 can be executed with a central drive journal at second guide roll 13.

At an infeed of first press stage P1 an additional suction guide roll 16 is arranged as a first of guide rolls 16-21 of second fabric 4 which is designed as a suction take off roll in order to transfer fibrous web B at the infeed from one fabric (not identified) of an upstream wire section (not identified) of machine 1 to second fabric 4 of first press stage P1 of press 2.

Press 2, in its second press stage P2 has a second press nip N2 that is formed between a press roll 30 and a counter press roll 31 of second press stage 2 in order to guide fibrous web B through, in a dewatering manner. In other words, second press stage P2 of press 2 is equipped with press roll 30 and counter press roll 31 which interact so that, together they form second press nip N2 in order to guide fibrous web B through said press nip, in a dewatering manner.

Press 2, in its second press stage P2 moreover has two ribbon-like fabrics 5, 6 wherein a first fabric 5 is in the embodiment of a bottom felt or bottom press felt and a second fabric 6 is in the embodiment of a top felt or top press felt.

First fabric 5 of second press stage P2 is guided by multiple guide rolls 32-35 (not all guide rolls are depicted in FIG. 1) in continuous circulation. Second fabric 6 of second press stage 2 is guided by another set of multiple guide rolls 36-40 (not all guide rolls are depicted in FIG. 1) in continuous circulation. Both fabrics 5, 6 are guided in second press stage P2 in such a way that they are brought together when running through second press nip N2 in order to run fibrous web B in a sandwich like manner through second press nip N2. Fabrics 5, 6 can be guided in such a way that they run together into second press nip N2. Both fabrics 5, 6 are moreover guided in second press stage P2 so that they are again separated after second press nip N2 at a second separation point T2 in order to continue to guide fibrous web B on first fabric 5 of second press stage P2 and to separate it from second fabric 6 of second press stage P2.

Suction guide roll 32 as the first of guide rolls 32-35 of first fabric 5 of second press stage P2, is arranged at second separation point T2 to hold fibrous web B at second separation point T2 on first fabric 5 of second press stage P2. Said suction first guide roll 32 is again designed as a suction felt guide roll. A second guide roll 33 of guide rolls 32-35 of first fabric 5 that immediately follows suction first guide roll 32 in continuous circulation of first fabric 5 of second press stage P2 is again equipped with a rotary drive. This rotary drive of second guide roll 33 of first fabric 5 of second press stage P2 can be executed with a central drive journal at second guide roll 33.

At an infeed of second press stage P2 an additional suction guide roll 36 is arranged as the first of guide rolls 36-40 of second fabric 6 of second press stage P2 which is designed as a suction take off roll in order to transfer fibrous web B at the infeed of second press stage P2 from first fabric 3 of the preceding first press stage P1 of press 2 to second fabric 6 of second press stage P2 of press 2.

At an outlet of second press stage P2 which viewed in direction of web travel R1 which is located directly after first suction guide roll 32, a suction guide roll 50 of a subsequent processing stage in machine 1 is arranged. This suction guide roll 50 of the subsequent processing stage in machine 1 is designed as a take off suction roll, to transfer fibrous web B at the outlet of second press stage P2 from first fabric 5 of second press stage P2 of press 2 to a fabric (not identified) of the subsequent processing stage in machine 1.

According to another embodiment of the invention a press 2' in a machine 1' (not shown in its entirety) for the production of a fibrous web B' is described below with reference to FIG. 2. In the second embodiment of the invention, press 2' is also designed as a tandem press with two consecutive press stages P1', P2'.

Machine 1' in the present embodiment of the invention is a paper machine for the production of a paper, cardboard or pulp web in the form of a fibrous web B'. Fibrous web B' is preferably a packaging paper web or a cardboard web and is run in press 2' at a web speed of ≥1100 m/min, preferably ≥1150 m/min and even more preferably ≥1200 m/min in a direction of web travel R1'.

In its first press stage P1', press 2' has a first press nip N1' which is formed between press roll 10' and a counter press roll 11' of first press stage P1' in order to guide fibrous web B' through, in a dewatering manner. In other words, first press stage P1' of press 2' is equipped with press roll 10' and counter press roll 11' which interact so that, together they form first press nip N1' in order to guide fibrous web B' through said press nip, in a dewatering manner.

In its first press stage P1', press 2' moreover has two ribbon-like fabrics 3', 4' wherein a first fabric 3' is in the embodiment of a bottom felt or bottom press felt and a second fabric 4' is in the embodiment of a top felt or top press felt.

Figure 2:
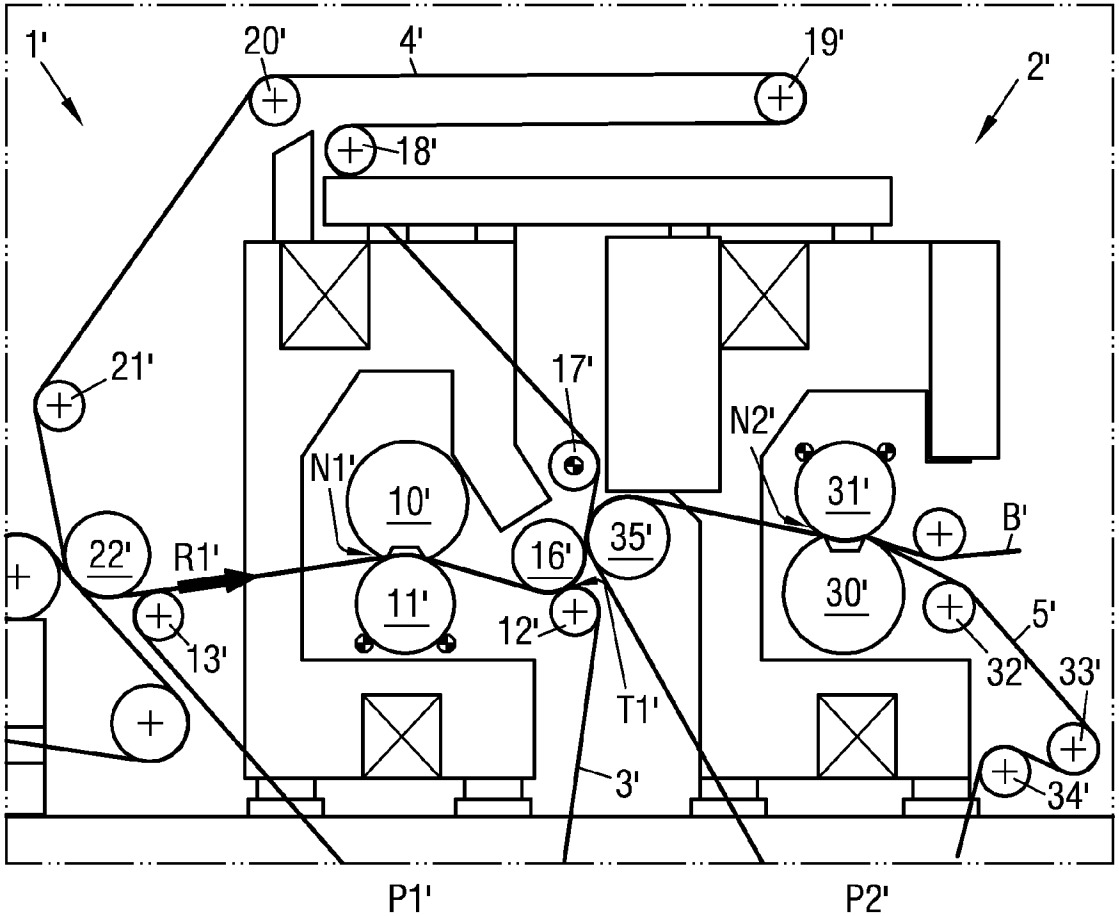
FIG. 2 shows a schematic side view of a press for a machine to produce a fibrous web according to another embodiment of the invention.

First fabric 3' is guided by multiple guide rolls 12', 13' (not all guide rolls are depicted in FIG. 2) in continuous circulation. Second fabric 4' is guided by another set of multiple guide rolls 16'-22' in continuous circulation. Both fabrics 3', 4' are guided in first press stage P1' in such a way that they are brought together when running through press nip N1' in order to run fibrous web B' in a sandwich like manner through first press nip N1'. Fabrics 3', 4' are guided preferably in such a way that they run together into first press nip N1'. Both fabrics 3', 4' are moreover led in first press stage P1' so that they are again separated after first press nip N1' at a first separation point T1' in order to continue to guide fibrous web B' on second fabric 4' of first press stage P1' and to separate it from first fabric 3' of first press stage P1'.

Suction guide roll 16' as the first of guide rolls 16'-22' of second fabric 4' is arranged at separation point T1' to hold fibrous web B' at separation point T1' on second fabric 4'. This first suction guide roll 16' is designed as a suction felt guide roll. A second guide roll 17' of guide rolls 16'-22' of second fabric 4' that immediately follows first suction guide roll 16' in continuous circulation of second fabric 4' can be equipped with a rotary drive. This rotary drive of second guide roll 17' of second fabric 4' is executed preferably with a central drive journal at second guide roll 17'.

An additional suction guide roll 22' is arranged at an infeed of first press stage P1' as the third of guide rolls 16'-22' of second fabric 4' which is designed as a suction take-off roll in order to transfer fibrous web B' at the infeed from one fabric (not identified) of an upstream wire section (not identified) of machine 1' to second fabric 4' of first press stage P1' of press 2'.

Press 2', in its second press stage P2' has a second press nip N2' that is formed between a press roll 30' and a counter press roll 31' of second press stage 2' in order to guide fibrous web B' through, in a dewatering manner. In other words, second press stage P2' of press 2' is equipped with press roll 30' and counter press roll 31' which interact so that, together they form second press nip N2' in order to guide fibrous web B' through said press nip, in a dewatering manner.

Press 2, in its second press stage P2' moreover has a single ribbon-like fabric 5' which is in the embodiment of a bottom felt or bottom press felt. Fabric 5' of second press stage P2' is guided by multiple guide rolls 32'-35' (not all guide rolls are depicted in FIG. 2) in continuous circulation. Fabric 5' is guided in second press stage P2' in such a way that it runs through second press nip N2' in order to guide fibrous web B' through second press nip N2'

At an infeed of second press stage P2' a suction guide roll 35' is arranged as the first of guide rolls 32'-35' of fabric 5' of second press stage P2' which is designed as a suction take-off roll in order to transfer fibrous web B' at the infeed of second press stage P2' from second fabric 4' of the preceding first press stage P1' of press 2' to fabric 5' of second press stage P2' of press 2'.

Below, embodiments of the inventive design variations of presses 2; 2' discussed above with reference to FIGS. 1 and 2 are addressed.

The rotary drive of respective guide rolls 13, 33, 17' that directly follow guide rolls 12, 32, 16' which are designed as suction felt rolls may be designed preferably for basis weights of fibrous web B, B' of 25 g/m$^2$ to 500 g/m$^2$.

The rotary drive of respective guide rolls 13, 33, 17' that directly follow guide rolls 12, 32, 16' which are designed as suction felt rolls may be designed so that it has a share of an overall rotary drive power of the respective press stage P1, P2, P1' of press 2, 2' of 15 percent to 25 percent. In other words, the share of the rotary drive amounts to 25 percent, preferably to 20 percent and even more preferably to 15 percent of the total rotary drive power of respective press stage P1, P2, P1' of press 2, 2'.

The rotary drive of respective guide rolls 13, 33, 17' that directly follow guide rolls 12, 32, 16' which are designed as suction felt rolls may be torque controlled, whereas a rotary drive at press nip N1, N2, N1' may be speed controlled.

Respective guide rolls 13, 33, 17' that directly follow guide rolls 12, 32, 16' which are designed as suction felt rolls with associated fabric 3, 5, 4' have a wrap angle of preferably 60 degrees to 90 degrees. In other words, the angle of wrap is ≥60 degrees, preferably ≥80 degrees and more preferably ≥90 degrees.

Guide rolls 13, 33 that directly follow guide rolls 12, 32 which are designed as suction felt rolls are pivoted so that, when pivoting the directly following guide roll 13, 33, a trajectory of the continuous circulation of associated fabric 3, 5 can be altered.

A shell surface of respective guide rolls 13, 33, 17' that directly follow guide rolls 12, 32, 16' which are designed as suction felt rolls is covered with a pressure absorbing or respectively soft material which has a coefficient of friction of 0.2 to 0.25. In other words, the coefficient of friction of the cover material is ≥0.2 and preferably ≥0.25.

Guide rolls 12, 32, 16' which are designed as suction felt rolls, with associated fabrics 3, 5, 4' preferably have an angle of wrap of at least 15 degrees to at least 40 degrees. In other words, the angle of wrap is ≥15 degrees, preferably ≥30 degrees and even more preferably ≥40 degrees.

Guide rolls 12, 32, 16' which are designed as suction felt rolls have at least two zones, wherein at least one zone is a high vacuum zone having a vacuum of 35 kPa to 50 kPa. In other words, the available vacuum of each high vacuum zone is ≥35 kPa, preferably ≥45 kPa and even more preferably ≥50 kPa. Guide rolls 12, 32, 16' which are designed as suction felt rolls may have at least three zones, wherein at least two zones respectively are high vacuum zones.

A respective transfer section from the departure point of the respective web supporting fabric, of guide rolls 12, 32, 16' which are designed as suction felt rolls, to the point of contact with guide roll 36, 50, 35' in the embodiment of take-off suction rolls located consecutively in the web path or respectively in direction of web travel R1, R1' for the transfer of fibrous web B, B' from fabric 3, 5, 4' that is allocated to guide rolls 12, 32, 16' which are in the embodiment of suction felt rolls to the respective downstream fabric 6, 5' in machine 1, 1' is 600 mm to 1000 mm. In other words, the transfer section is ≤1000 mm, preferably ≤800 mm and even more preferably ≤600 mm.

Guide rolls 12, 32, 16' in the embodiment of suction felt rolls respectively have no rotary drive and no transmission. Alternatively, hereto, guide rolls 12, 32, 16' in the embodiment of suction felt rolls roll can however also be equipped with a rotary drive and possibly with a transmission in order to better distribute the rotary drive power in respective press stage P1, P2, P1'.

At least one of press nips N1, N2, N1', N2' of press 2, 2' is in the embodiment of a shoe press, wherein each shoe press generates a press force of preferably >1000 kN/m and has a shoe length of preferably >250 mm.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

1; 1' Machine
2; 2' Press
3, 4 Fabric
5,6 Fabric
10; 10' Press roll
11; 11' Counter press roll
12-15 Guide rolls
12', 13' Guide rolls
16-21 Guide rolls
16'-22' Guide rolls
30; 30' Press roll
31; 31' Counter press roll
32-35 Guide rolls
32'-35' Guide rolls
36-40 Guide rolls
50 Guide roll
B; B' Fibrous web
N1, N2 Press nip
N1', N2' Press nip
P1, P2 Press stage
P1', P2' Press stage R1; R1' Direction of web travel
T1, T2 Separation point
T1' Separation point

What is claimed is:

1. A press for a machine to produce a fibrous web, comprising:

at least one press nip formed between a press roll and a counter press roll of the press for guiding the fibrous web in a dewatering manner;

a plurality of guide rolls guiding a first ribbon like fabric and a second ribbon like fabric in a continuous circulation such that the first ribbon like fabric and the second ribbon like fabric are brought together through the at least one press nip with the fibrous web arranged between the first ribbon like fabric and the second ribbon like fabric through the at least one press nip;

a separation point, located downstream in the continuous circulation from the at least one press nip, for guiding the fibrous web on the first ribbon like fabric and separating it from the second ribbon like fabric;

a first guide roll of the plurality of guide rolls being arranged at the separation point is a vacuum equipped guide roll of the first ribbon like fabric, holding the fibrous web on the first ribbon like fabric at the separation point, and the first guide roll does not include a rotary drive and a transmission; and a second guide roll of the plurality of guide rolls of the first ribbon like fabric, located directly following the vacuum equipped guide roll in the continuous circulation of the first ribbon like fabric, is equipped with a first rotary drive.

2. The press according to claim 1, wherein the first rotary drive of the second guide roll of the plurality of guide rolls is designed for basis weights of the fibrous web of 25 g/m$^2$ to 500 g/m$^2$.

3. The press according to claim 1, wherein the first rotary drive of the second guide roll of the plurality of guide rolls contributes 15 to 25% of a total rotary drive power of the at least one press nip.

4. The press according to claim 1, wherein the first rotary drive of the second guide roll of the plurality of guide rolls is torque controlled, and a second rotary drive of the at least one press nip is speed controlled.

5. The press according to claim 1, wherein the second guide roll of the plurality of guide rolls with the first ribbon like fabric has a first angle of wrap of 60 to 90 degrees.

6. The press according to claim 1, wherein the second guide roll of the plurality of guide rolls is pivotably mounted whereby pivoting the second guide roll of the plurality of guide rolls, a trajectory of the continuous circulation of the first ribbon like fabric is altered.

7. The press according to claim 1, wherein a shell surface of the second guide roll of the plurality of guide rolls is covered with a pressure absorbing material with a coefficient of friction of 0.2 to 0.25.

8. The press according to claim 1, wherein the vacuum equipped guide roll with the first ribbon like fabric has a second angle of wrap of 15 to 40 degrees.

9. The press according to claim 1, wherein the vacuum equipped guide roll has at least two zones, wherein at least one of the at least two zones is a high vacuum zone having a vacuum of 35 to 50 kPa.

10. The press according to claim 1, wherein a transfer section from the vacuum equipped guide roll to a receiving suction roll located downstream in a travel path of the fibrous web for the transfer of the fibrous web from the first ribbon like fabric to a downstream fabric is 600 to 1000 mm.

* * * * *